US009097213B2

(12) United States Patent
Gotoh et al.

(10) Patent No.: US 9,097,213 B2
(45) Date of Patent: Aug. 4, 2015

(54) CARBURETOR

(71) Applicant: KEIHIN CORPORATION, Tokyo (JP)

(72) Inventors: Takashi Gotoh, Shioya-gun (JP); Yasushi Ono, Kakuda (JP)

(73) Assignee: KEIHIN CORPORATION, Tokyo (JP)

( * ) Notice: Subject to any disclaimer, the term of this patent is extended or adjusted under 35 U.S.C. 154(b) by 322 days.

(21) Appl. No.: 13/799,525

(22) Filed: Mar. 13, 2013

(65) Prior Publication Data

US 2013/0249121 A1 Sep. 26, 2013

(30) Foreign Application Priority Data

Mar. 22, 2012 (JP) ..... 2012-065635

(51) Int. Cl.

| | |
|---|---|
| ***B01F 3/04*** | (2006.01) |
| ***F02M 17/06*** | (2006.01) |
| ***F02M 5/00*** | (2006.01) |
| ***F02M 7/133*** | (2006.01) |

(52) U.S. Cl.

CPC ..... *F02M 17/06* (2013.01); *F02M 5/00* (2013.01); *F02M 7/133* (2013.01)

(58) Field of Classification Search

CPC ..... F02M 5/00; F02M 7/133; F02M 17/06
USPC ..... 261/41.1, 41.2, 41.3
See application file for complete search history.

(56) References Cited

U.S. PATENT DOCUMENTS

| | | | | | |
|---|---|---|---|---|---|
| 1,994,944 | A | * | 3/1935 | Cole | 261/34.2 |
| 2,204,527 | A | * | 6/1940 | Boyce | 261/69.1 |
| 2,227,267 | A | * | 12/1940 | Lozivit | 261/24 |
| 4,364,354 | A | * | 12/1982 | Kosuge et al. | 123/437 |
| 4,422,423 | A | * | 12/1983 | Sugiyama et al. | 123/438 |
| 4,494,504 | A | * | 1/1985 | Yagi et al. | 123/308 |
| 6,062,179 | A | * | 5/2000 | Gohara et al. | 123/73 A |

FOREIGN PATENT DOCUMENTS

| | | | |
|---|---|---|---|
| DE | 352077 | * | 4/1922 |
| FR | 498818 | * | 1/1920 |
| GB | 138177 | * | 2/1920 |
| JP | 2008-69640 A | | 3/2008 |

* cited by examiner

*Primary Examiner* — Charles Bushey
(74) *Attorney, Agent, or Firm* — Westerman, Hattori, Daniels & Adrian, LLP

(57) ABSTRACT

A carburetor includes a main fuel path connected to a main nozzle and a slow fuel path connected to a slow port. The main fuel path and the slow fuel path are separated from each other and are independently communicated to a constant fuel chamber below a fuel level of the fuel chamber. The slow fuel path includes a first slow jet located above the fuel level and a second slow jet located in the downstream of the first slow jet. A opening size of the second slow jet is smaller than that of the first slow jet, and the first and second slow jets are arranged in series.

5 Claims, 3 Drawing Sheets

CARBURETOR

CROSS REFERENCES TO RELATED APPLICATIONS

The present application claims priority under 35 U.S.C. §119 to Japanese Patent Application No. 2012-65635, filed Mar. 22, 2012, entitled "Carburetor." The contents of this application are incorporated herein by reference in their entirety.

TECHNICAL FIELD

An exemplary subject matter relates to a carburetor suitable for a universal engine of a power source of various working machines, in particular to the improvement of a carburetor. A main nozzle is opened on a venturi portion of an intake path disposed on the carburetor body, and a slow port is opened on an intake path closer to the downstream than the venturi portion, respectively. A constant fuel chamber is provided in the lower part of the carburetor body. The constant fuel chamber stores a certain amount of fuel to be drawn out by the main nozzle and slow port.

BACKGROUND

There is known a carburetor disclosed in Japanese Unexamined Patent Application Publication No. 2008-69640.

SUMMARY

In the carburetor described in the above Japanese Unexamined Patent Application Publication No. 2008-69640, the main nozzle is communicated to the constant fuel chamber underneath the fuel level of the constant fuel chamber via a main jet and a common jet, and furthermore, the slow port is communicated to the fuel chamber underneath the fuel level via a slow jet and the common jet. Thus, the respective fuel flow rates to the main nozzle and to the slow port are measured in two stages by two jets, enabling to enlarge the size of opening of each jet. As a result, not only the processing of each jet become easier, but also the clogging of the jet caused by foreign substances etc. can be prevented effectively. However, in such a carburetor, the upstream jet of the two jets communicated to the main nozzle and the upstream jet of the two jets communicated to the slow port, become the common jet for the main nozzle and the slow port. This common jet necessarily performs measurement of large flow rate, and is therefore particularly unsuitable for measurement of fuel flow rate to the slow port, which requires micro-amount measurement. Accordingly, in this carburetor, the measurement of fuel flow rate to the slow port will be basically performed by the one slow jet, thus requiring the diameter of opening of the slow jet to be more sufficiently small. This requirement is not compatible with realizing easy processing of the jet and preventing clogging of the jet at the same time. Further, since the slow jet is arranged below the fuel level of the constant fuel chamber, when the fuel level varies due to the movement of the carburetor, the measurement for fuel flow rate to the slow port changes slightly. In particular, this will affect the fuel consumption at the time of the idling or slow running of the engine.

Thus, it is preferable to provide a carburetor, which is free from the effects of variation in fuel level of the constant fuel chamber, is always able to appropriately perform the measurement of fuel flow rate to the slow port, thus not only making processing of the two jets for measuring this fuel flow rate easier, but also preventing clogging of the jets.

Accordingly, in one aspect, a carburetor includes a carburetor body including an air intake path including a venturi portion, the carburetor body further including a main nozzle opened at the venturi portion and a slow port opened on the air intake path in a downstream of the venturi portion; a constant fuel chamber provided at a lower part of the carburetor body to store a certain amount of fuel to be drawn out through the main nozzle and the slow port; a main fuel path connected to the main nozzle; and a slow fuel path connected to the slow port. The main fuel path and the slow fuel path are separated from each other and are independently communicated to the inside of the fuel chamber below a fuel level of the fuel chamber. The slow fuel path includes a first slow jet disposed above the fuel level and a second slow jet disposed in a downstream of the first slow jet and including an opening size smaller than that of the first slow jet, and the first slow jet and the second slow jet are arranged in series.

By this aspect, it is possible to make the drawing and measurement of the fuel in the main fuel path and the slow fuel path not to interfere with each other by causing the main fuel path and the slow fuel path to separate from each other to be formed independently and to communicate to the chamber underneath the fuel level of the constant fuel chamber, thus promoting the stable idling or slow low-load running and fast high-load running of the engine.

Further, by arranging in series, on the slow fuel path, the first slow jet located above said fuel level and the second slow jet which is located in the downstream of the first slow jet and of which an opening size is smaller than that of the first slow jet, the fuel ejected from the slow jet is measured accurately in two stages by the first and second slow jets, and the flow rate can be controlled to an amount corresponding to the idling or slow low-load running of the engine, thus realizing promotion of running performance and reduction of fuel consumption.

Moreover, since both of the first and second slow jets are arranged above the fuel level of the constant fuel chamber, they can be free from effects of variation in fuel level of the constant fuel chamber, thus always exerting stable measurement function.

In another aspect, the slow fuel path includes a linear longitudinal fuel path disposed along and in proximity to a longitudinal centerline of the fuel chamber, a linear transverse fuel path disposed parallel with the air intake path on a side of the air intake path, and connected to the slow port, and a linear oblique fuel path intersects the longitudinal fuel path and the transverse fuel path to communicates the longitudinal fuel path to the transverse fuel path.

By this aspect, the slow fuel path includes a linear longitudinal fuel path, a linear transverse fuel path and a linear oblique fuel path. The longitudinal fuel path is arranged along the longitudinal central axis of the constant fuel chamber and close to this axis. The transverse fuel path is provided on the side of the intake path, is arranged in parallel with the intake path and is connected with the slow port. The oblique fuel path communicates the longitudinal fuel path to the transverse fuel path, and intersects with them. Thus, substantially free from effects of variation in fuel level of the constant fuel chamber, the slow fuel path can accurately draw the fuel of the constant fuel chamber from the longitudinal fuel path, ensuring stable idling or slow low-load running of the engine.

Furthermore, the intersection angle of the longitudinal fuel path and the oblique fuel path is an obtuse angle of more than 90°, which can suppress the integrated flow path resistance of the slow fuel path to be relatively small. As a result, free from interference of this flow path resistance, the setting of measurement performance of the first and second slow jets can be performed correctly. On this basis, it becomes easy to process the bores of the three linear fuel paths in the carburetor body.

In further aspect, the first slow jet may be formed at the upper end of the longitudinal fuel path.

According to this aspect, since the first slow jet is formed at the upper end of the longitudinal fuel path, the first slow jet can be easily formed at the time of bore processing of the longitudinal fuel path.

Moreover, a jet block containing the second slow jet may be embedded and mounted on the oblique fuel path.

According to this aspect, on the oblique fuel path which is free from effects of the main fuel path, and of which diameter can be processed to be relatively large, a jet block with a relatively large diameter including the second slow jet can be easily embedded and mounted.

Furthermore, an opening area of the first slow jet may be set to 1.5 to 2 times inclusive larger than the second slow jet.

According to this aspect, by setting the opening area of the first slow jet to 1.5 to 2 times larger than the second slow jet, the measurement burden of each slow jet is averaged. As a result, the fuel used during the idling or slow low-load running of the engine can be measured reasonably and appropriately, thus further realizing improvement of running performance and reduction of fuel consumption.

BRIEF DESCRIPTION OF THE DRAWINGS

The advantages of the disclosure will become apparent in the following description taken in conjunction with the drawings, in which.

DETAILED DESCRIPTION

An exemplary embodiment will be described below with reference to the drawings.

Figure 1:
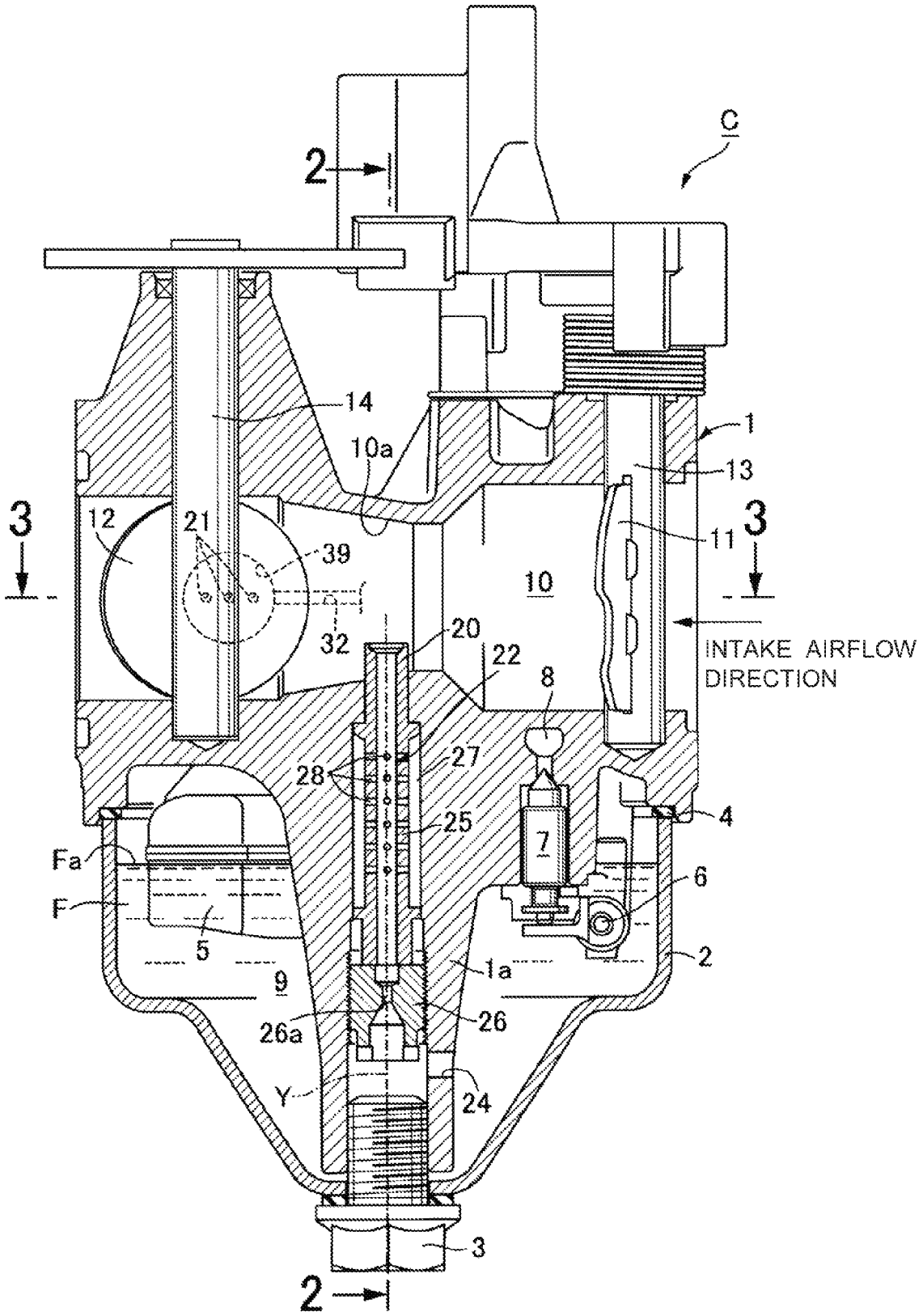
FIG. 1 is a longitudinal sectional front view of a carburetor according to one embodiment.
Figure 2:
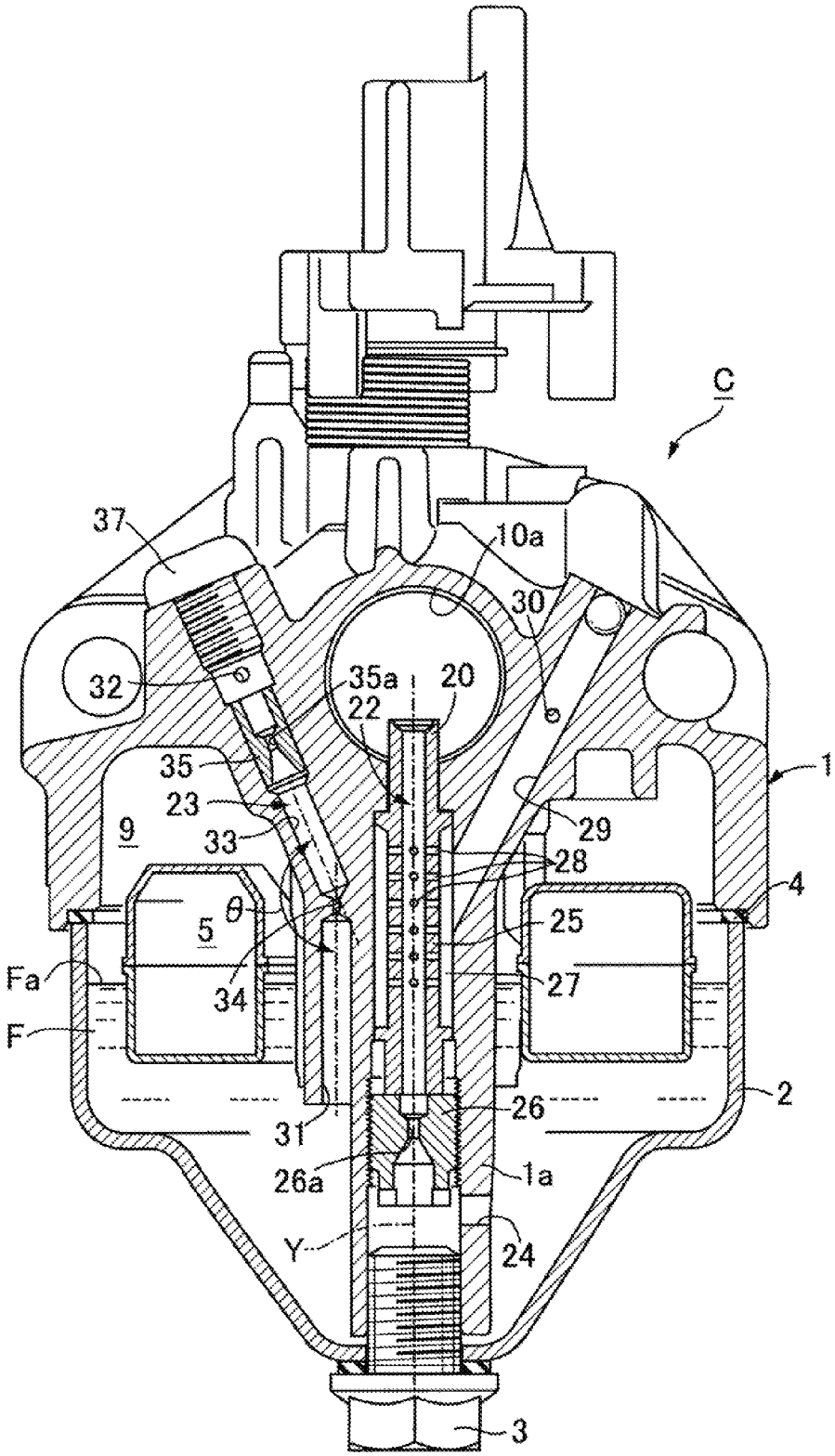
FIG. 2 is a sectional view taken along Line 2-2 of FIG. 1.

Firstly, in FIG. 1 and FIG. 2, the carburetor C includes a carburetor body 1 with an air intake path 10 extending in the horizontal direction, and a float chamber body 2 connected to the lower part of this carburetor body 1. The carburetor body 1 integrally includes a fuel boss 1*a* protruding into the float chamber body 2 from lower center part of the carburetor body 1. By fastening the bottom of the float chamber body 2 to the lower end of said fuel boss 1*a* using a sealing bolt 3, the float chamber body 2 can be connected to the lower part of the carburetor body 1 via an interposed sealing member 4.

Inside the float chamber body 2, a float 5 is pivoted to the carburetor body 1 by a shaft bracket 6 such that the float 5 is pivotable about the shaft, and a float valve 7 operating in linkage with lifting and falling movements of this float 5 is arranged. A fuel supply path 8 is opened and closed by opening and closing operation of the float valve 7. The fuel is supplied to the fuel supply path 8 from a fuel tank (not shown in the figure).

When the float 5 is lowered, the float valve 7 opens the valve to open the fuel supply path 8 from which the fuel is supplied into the float chamber body 2. When the input fuel reaches a predetermined amount or more, the valve is closed by lifting the float 5 to block the fuel supply path 8. By this operation, the interior of the float chamber body 2 becomes the constant fuel chamber 9 which maintains a certain amount of fuel F stored therein.

In the intake path 10, a choke valve 11 is arranged on the upstream side of the venturi portion 10*a*, and a throttle valve 12 is arranged on the downstream side of the venturi portion 10*a* such that the venturi portion 10*a* is located between the choke valve 11 and the throttle valve 12. The choke valve 11 is mounted on a longitudinal chock axis 13 freely rotatably-supported by the carburetor body 1. The intake path 10 is opened and closed by rotation of this chock axis 13. Moreover, the throttle valve 12 is mounted on a longitudinal throttle axis 14 freely rotatably-supported by the carburetor body 1. The intake path 10 is opened and closed by rotation of this throttle axis 14.

At the venturi 10*a*, a main nozzle 20 is opened. When the throttle valve 12 is opened to an idling opening degree, a plurality of slow ports is opened on the intake path 10 in the vicinity thereof. The main nozzle 20, via a main fuel path 22, and the slow port 21, via a slow fuel path 23, are independently communicated to the inside of the constant fuel chamber 9 below the fuel level Fa of the constant fuel chamber 9.

The main fuel path 22 is disposed in said fuel boss 1*a*. That is, the main fuel path 22 includes a bleed air pipe 25 and a jet block 26. The bleed air pipe 25 is connected and arranged integrally with the lower end of the main nozzle 20, and is supported by the fuel boss 1*a*. The jet block 26 is arranged under the fuel level Fa, and it is screwed and mounted on the fuel boss 1*a* to abut against the lower end of the bleed air pipe 25. A main jet 26*a* is formed in the jet block 26. In the main fuel path 22, the intermediate and lower parts of the bleed air pipe 25 sink below the fuel level Fa of the constant fuel chamber 9. A through hole 24 which communicates the main jet 26*a* to the inside of the chamber 9 underneath the fuel level Fa is disposed at the lower part of the fuel boss 1*a*. This main fuel path 22 includes the main nozzle 20, and is arranged on the longitudinal centerline Y of the constant fuel chamber 9.

A cylindrical bleed air chamber 27 is arranged between the outer peripheral surface of the bleed air pipe 25 and the inner peripheral surface of the fuel boss 1*a*. The circumferential wall of the bleed air pipe 25 is perforated with a plurality of bleed air holes 28 which communicate the interior of the bleed air pipe 25 to the bleed air chamber 27. The air is supplied to the bleed air chamber 27 from a main bleed air path 29 which is opened at the upstream end of the carburetor body 1 (see FIG. 3). A main air jet 30 for measuring the air flow rate is arranged in the main bleed air path 29.

As shown in FIG. 2, the slow fuel path 23 includes a linear longitudinal fuel path 31, a linear transverse fuel path 32 and a linear oblique fuel path 33. The longitudinal fuel path 31 is arranged along the main fuel path 22 and close to this main fuel path 22, and its lower end is opened under the fuel level Fa. The transverse fuel path 32 is provided on one side of the intake path 10, is arranged in parallel with the intake path 10 and one end of the transverse fuel path 32 connects to the slow ports 21. The oblique fuel path 33 communicates the upper end of the longitudinal fuel path 31 to the other end of the transverse fuel path 32, and intersects with them. The longitudinal fuel path 31 is formed by perforating to the lower part of the fuel boss 1*a*, and at the upper end of the longitudinal fuel path 31, there is formed a first slow jet 34 that is coaxial to the longitudinal fuel path 31. Thus, after perforation of the longitudinal fuel path 31, the first slow jet 34 is formed by perforating through this longitudinal fuel path 31.

The oblique fuel path 33 is formed by perforating obliquely downwardly in the carburetor body 1. A jet block 35 including the second slow jet 35*a* is pressed into the upper part of the oblique fuel path 33. The perforation opening of the oblique fuel path 33 is closed and blocked by a plug bolt 37.

The opening size of the first slow jet 34 is formed to be larger than the opening size of the second slow jet 35*a*. It is preferable that the opening area of the first slow jet 34 is set to 1.5 to 2 times inclusive larger than the second slow jet 35*a*.

Figure 3:
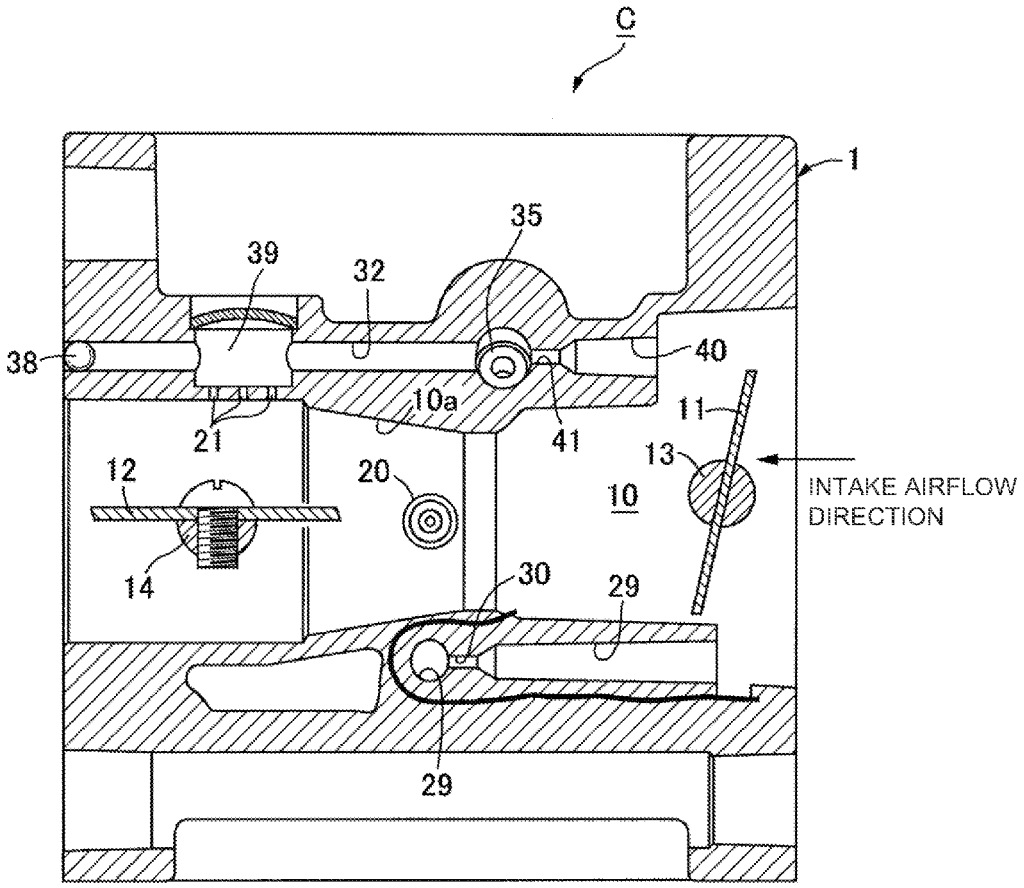
FIG. 3 is a sectional view taken along Line 3-3 of FIG. 1.

As shown in FIG. 3, the transverse fuel path 32 is formed by perforating from one end surface located on the downstream side of the carburetor body 1. This perforation opening is closed and blocked by a ball plug 38. The transverse fuel path 32 is communicated to a plurality of slow ports 21 via a cylindrical mixing chamber 39 formed in the carburetor body 1.

Furthermore, in the carburetor body 1, a slow bleed air path 40 extending from the upstream end of the carburetor body 1 to the upper end of the oblique fuel path 33 is also formed by perforation. A slow air jet 41 is formed at the downstream end of this slow bleed air path 40.

Next, the operation of this embodiment will be explained. In the idling or slow low-load running state of the engine, in which the throttle valve 12 is set to an idling opening degree or a lower opening degree, the intake path 10 is tightened or made narrower by the throttle valve 12 near the slow port 21. Therefore, the velocity of the intake flow which flows between the throttle valve 12 and the slow port 21 increases, which causes a negative pressure to act on the slow port 21. According to the intensity of this negative pressure, the fuel of the constant fuel chamber 9 rises in the slow fuel path 23.

That is, the fuel of the constant fuel chamber 9 first rises in the longitudinal fuel path 31, undergoes measurement of the first stage by the first slow jet 34, and then undergoes measurement of the second stage by the second slow jet 35*a* while rising in the oblique fuel path 33. The fuel then turns into the transverse fuel path 32, being mixed with the bleed air flowing into the slow bleed air path 40, then enters the mixing chamber 39 and is further mixed, and becomes emulsion-like fuel and is ejected to the intake path 10 from the slow ports 21. This emulsion-like fuel can be sufficiently mixed with the intake air, of which the flow rate has been adjusted by the throttle valve 12 in the intake path 10, to generate a good mixed gas, thus promoting good idling or slow low-load running of the engine.

In particular, the fuel to be ejected from the slow port 21 undergoes precise measurement of two stages by the above-mentioned first slow jet 34 with a larger opening size and the second slow jet 35*a* with a smaller opening size. Therefore, the flow rate can be controlled to be at a flow rate accurately corresponding to the idling or slow low-load running of the engine, thus contributing to realizing improvement of running performance and reduction of fuel consumption.

Moreover, since both of the first and second slow jets 34 and 35*a* are arranged above the fuel level Fa of the constant fuel chamber 9, they can be free from effects of variation in the fuel level Fa of the constant fuel chamber 9, and can always exert stable measurement function.

In addition, through the use of two slow jets 34 and 35*a*, it is possible to set the opening size of respective slow jets 34 and 35*a* to be relatively larger, thus not only facilitating the opening processing, but also preventing the clogging of the jets caused by foreign substances etc.

In this case, the opening area of the first slow jet 34 is set to 1.5 to 2 times larger than the second slow jet 35*a*. As a result, the measurement burden of respective slow jets 34 and 35*a* can be averaged, and the fuel used for the idling or slow low-load running of the engine can be measured reasonably and appropriately, thus further realizing improvement of running performance and reduction of fuel consumption.

In addition, the slow fuel path 23 includes the linear longitudinal fuel path 31, the linear transverse fuel path 32 and the linear oblique fuel path 33. The longitudinal fuel path 31 is arranged along the longitudinal centerline Y of the constant fuel chamber 9 and close to this line. The transverse fuel path 32 is provided on one side of the intake path 10, is arranged in parallel with the intake path and is connected with the slow ports 21. The oblique fuel path 33 communicates the longitudinal fuel path 31 to the transverse fuel path 32 and intersects with them. The longitudinal fuel path 31 is arranged close to the longitudinal centerline Y of the constant fuel chamber 9, so that it is free from the effects of variation in the fuel level Fa of the constant fuel chamber 9, and the slow fuel path 23 can reliably draw the fuel, thus ensuring stable idling or slow low-load running of the engine.

Furthermore, the intersection angle θ of the longitudinal fuel path 31 and the oblique fuel path 33 is an obtuse angle of more than 90°, so that the integrated flow path resistance of the slow fuel path 23 can be suppressed to be relatively smaller. As a result, free from (or with nominal amount of) interference of this flow path resistance, the setting of measurement performance of the first and second slow jets 34 and 35*a* can be performed reliably. On this basis, it becomes easier to process the bores of the three linear fuel paths 31 to 33 to the carburetor body 1.

In addition, the first slow jet 34 is formed at the upper end of the longitudinal fuel path 31, and thus, this first slow jet 34 can be easily formed at the time of bore processing of the longitudinal fuel path 31.

Additionally, the oblique fuel path 33 can be processed to have a relatively large diameter without interference by the main fuel path 22 etc. As a result, in this oblique fuel path 33, the jet block 35 having a relatively large diameter and including the second slow jet 35*a* can be very easily inserted and embedded.

On the other hand, in a fast high-load running state of the engine, in which the throttle valve 12 is set to a high opening degree, in the intake path 10, the part with a relatively faster intake flow velocity shifts from the throttle valve area to the venturi portion 10*a* corresponding to the increase of intake flow rate of the engine, thus generating a negative pressure at the venturi portion 10*a*. According to the intensity of this negative pressure, the fuel of the constant fuel chamber 9 rises in the main fuel path 22.

That is, the fuel of the constant fuel chamber 9 is first measured by the main jet 26*a* as a flow rate corresponding to the fast high-load running of the engine, and rises in the bleed air pipe 25. During the rise, the air flowing into the main bleed air path 29 flows into the bleed air pipe 25 from a plurality of bleed air holes 28 via the bleed air chamber 27, and is mixed with the fuel in the bleed air pipe 25. Thus, this fuel becomes emulsion-like and is ejected from the main nozzle 20. This fuel can be sufficiently mixed with the intake air, of which the flow rate has been adjusted by the throttle valve 12 in the intake path 10, to generate a good mixed gas, thus promoting good fast high-load running of the engine.

The main fuel path 22 and the slow fuel path 23 are formed separately and independently from each other. In addition, the main jet 26*a* is arranged in the main fuel path 22, and the first and second slow jets 34 and 35*a* are arranged in the slow fuel path 23, respectively. Therefore, it is possible to make the fuel drawing and measurement of the main fuel path 22 and the slow fuel path 23 not to interfere with each other, thus promoting the stabilization of the idling or slow low-load running and fast high-load running of the engine.

The present invention is not limited to the above embodiments, and various changes in design can be made without departing from the scope of the gist thereof.

We claim:

1. A carburetor comprising:

a carburetor body including an air intake path including a venturi portion, the carburetor body further including a main nozzle opened at the venturi portion and a slow port opened on the air intake path downstream of the venturi portion;

a constant fuel chamber provided at a lower part of the carburetor body to store a certain amount of fuel to be drawn out through the main nozzle and the slow port;

a main fuel path connected to the main nozzle; and a slow fuel path connected to the slow port, wherein the main fuel path and the slow fuel path are separated from each other and are independently communicated to the inside of the fuel chamber below a fuel level of the fuel chamber, and wherein the slow fuel path includes a first slow jet disposed above the fuel level and a second slow jet disposed downstream of the first slow jet and including a opening size smaller than that of the first slow jet, and the first slow jet and the second slow jet are arranged in series.

2. The carburetor according to claim 1, wherein the slow fuel path includes:

a linear longitudinal fuel path disposed along and in proximity to a longitudinal centerline of the fuel chamber, a linear transverse fuel path disposed parallel with the air intake path on a side of the air intake path, and connected to the slow port, and a linear oblique fuel path intersects the longitudinal fuel path and the transverse fuel path to communicate the longitudinal fuel path to the transverse fuel path.

3. The carburetor according to claim 2, wherein the first slow jet is disposed at the upper end of the longitudinal fuel path.

4. The carburetor according to claim 2, wherein a jet block including the second slow jet is inserted in the oblique fuel path.

5. The carburetor according to claim 1, wherein a opening area of the first slow jet is set to 1.5 to 2 times inclusive larger than the second slow jet.

* * * * *